United States Patent [19]

D'Amato et al.

[11] Patent Number: 4,887,001

[45] Date of Patent: Dec. 12, 1989

[54] CATHODE-RAY TUBE HAVING FACEPLATE PANEL WITH ESSENTIALLY PLANAR SCREEN PERIPHERY

[75] Inventors: Ralph J. D'Amato; Richard H. Godfrey; Albert M. Morrell; Frank R. Ragland, Jr., all of Lancaster, Pa.

[73] Assignee: RCA Licensing Corporation, Princeton, N.J.

[21] Appl. No.: 342,677

[22] Filed: Apr. 25, 1989

Related U.S. Application Data

[63] Continuation of Ser. No. 814,164, Dec. 23, 1985, abandoned, which is a continuation of Ser. No. 529,644, Sep. 6, 1983, abandoned.

[51] Int. Cl.[4] ..... H01J 29/10; H01J 29/86

[52] U.S. Cl. ..... 313/461; 313/477 R

[58] Field of Search ..... 313/461, 477 R, 402; 220/2.1 A, 2.3 A

[56] References Cited

U.S. PATENT DOCUMENTS

| | | | |
|---|---|---|---|
| Re. 27,259 | 12/1971 | Rublack | 313/70 C |
| 1,705,661 | 3/1930 | Bown . | |
| 2,728,012 | 12/1955 | Swedlund . | |
| 3,931,906 | 1/1976 | Bradu . | |
| 4,136,300 | 1/1979 | Morrell | 313/403 |
| 4,535,907 | 8/1985 | Tokita et al. | 220/2.1 A |
| 4,537,321 | 8/1985 | Tokita | 220/2.1 A |
| 4,537,322 | 8/1985 | Okada et al. | 220/2.1 A |

FOREIGN PATENT DOCUMENTS

| | | |
|---|---|---|
| 1514691 | 9/1969 | Fed. Rep. of Germany . |
| 55-28269 | 2/1980 | Japan . |
| 694977 | 7/1953 | United Kingdom . |
| 1144354 | 3/1969 | United Kingdom . |

*Primary Examiner*—Kenneth M. Schor

*Attorney, Agent, or Firm*—Joseph S. Tripoli; Dennis H. Irlbeck

[57] ABSTRACT

The present invention provides an improvement in the appearance of a cathode-ray tube including a rectangular faceplate with an exterior surface having curvature along both the minor and major axes. The faceplate also includes a cathodoluminescent screen on an interior surface thereof. At least in the center portion of the faceplate, the curvature along the minor axis is at least 10 percent greater than the curvature along the major axis. Points on the exterior surface near the ends of the major axis, at the edges of the screen, lie in a first plane which is perpendicular to the central longitudinal axis of the tube; points on the exterior surface near the ends of the minor axis, at the edges of the screen, lie in a second plane which is spaced from and parallel to the first plane; and points on the exterior surface near the ends of the diagonals of the rectangular faceplate, at the edges of the screen, lie in a third plane which is spaced from and parallel to the first plane. The three planes are spaced from the center portion of the faceplate in the order of second plane, first plane and third plane.

3 Claims, 5 Drawing Sheets

CATHODE-RAY TUBE HAVING FACEPLATE PANEL WITH ESSENTIALLY PLANAR SCREEN PERIPHERY

This is a continuation of application Ser. No. 814,164, filed Dec. 23, 1985, now abandoned, which in turn is a continuation of application Ser. No. 529,644, filed Sept. 6, 1983, now abandoned.

This invention relates to cathode-ray tubes (CRT's) and, particularly, to the surface contours of the faceplate panels of such tubes.

BACKGROUND OF THE INVENTION

There are two basic faceplate panel contours utilized commercially for rectangular CRT's having screen sizes greater than about a 23 cm diagonal: spherical, and cylindrical. Although flat contours are possible, the added thickness and weight of the faceplate panel required to maintain the same envelope strength are undesirable. Furthermore, if a flat faceplate CRT is a shadow mask color picture tube, the additional weight and complexity of an appropriate shadow mask also are undesirable.

Recently, it has been suggested that spherically-shaped CRT faceplate panels be improved by increasing the radius of curvature of the panels by a factor of 1.5 to 2. Such increase in radius of curvature reduces the curvature of the faceplate panel, thereby permitting more satisfactory off-axis viewing of a tube screen. Although such tubes having increased radius of curvature do provide improved viewing, there is still a need for even flatter faceplates or, alternatively, for tubes that appear to be flatter.

A new faceplate panel contour concept which creates the illusion of flatness is disclosed in three recently-filed, copending U.S. Applications: Ser. No. 469,772, filed by F. R. Ragland, Jr. on Feb. 25, 1983 and now U.S. Pat. No. 4,839,556; Ser. No. 469,774, filed by F. R. Ragland, Jr. on Feb. 25, 1983 and now U.S. Pat. No. 4,786,840; and Ser. No. 469,775, filed by R. J. D'Amato et al. on Feb. 25, 1983 and now abandoned. The contour has curvature along both the major and minor axes of the faceplate panel, but is nonspherical. In a preferred embodiment described in these applications, the peripheral border of the tube screen is planar. In such tubes, it is important to contour the faceplate panel diagnosis so that the differing curvatures extending from the major and minor axes are properly blended. In the above-cited U.S. application Ser. No. 469,774, this blending is accomplished by permitting at least one sign change of the second derivative of the diagonal contour in the center-to-corner direction.

The present invention provides a novel faceplate panel contour which appears flatter than the suggested longer radius tubes and which does not require the use of much thicker glass to maintain tube strength.

SUMMARY OF THE INVENTION

The present invention provides an improvement in a cathode-ray tube including a rectangular faceplate which has an exterior surface having curvature along both the minor and major axes. The faceplate also includes a cathodoluminescent screen on an interior surface thereof. At least in the center portion of the faceplate, the curvature along the minor axis is at least 10 percent greater than the curvature along the major axis. In the improvement, points on the exterior surface near the ends of the major axis, at the edges of the screen, lie in a first plane which is perpendicular to the central longitudinal axis of the tube; points on the exterior surface near the ends of the minor axis, at the edges of the screen, lie in a second plane which is spaced from and parallel to the first plane; and points on the exterior surface near the ends of the diagonals of the rectangular faceplate, at the edges of the screen, lie in a third plane which is spaced from and parallel to the first plane. The three planes are spaced from the center portion of the faceplate in the order of second plane, first plane and third plane.

DETAILED DESCRIPTION OF THE PREFERRED EMBODIMENTS

Figure 1:
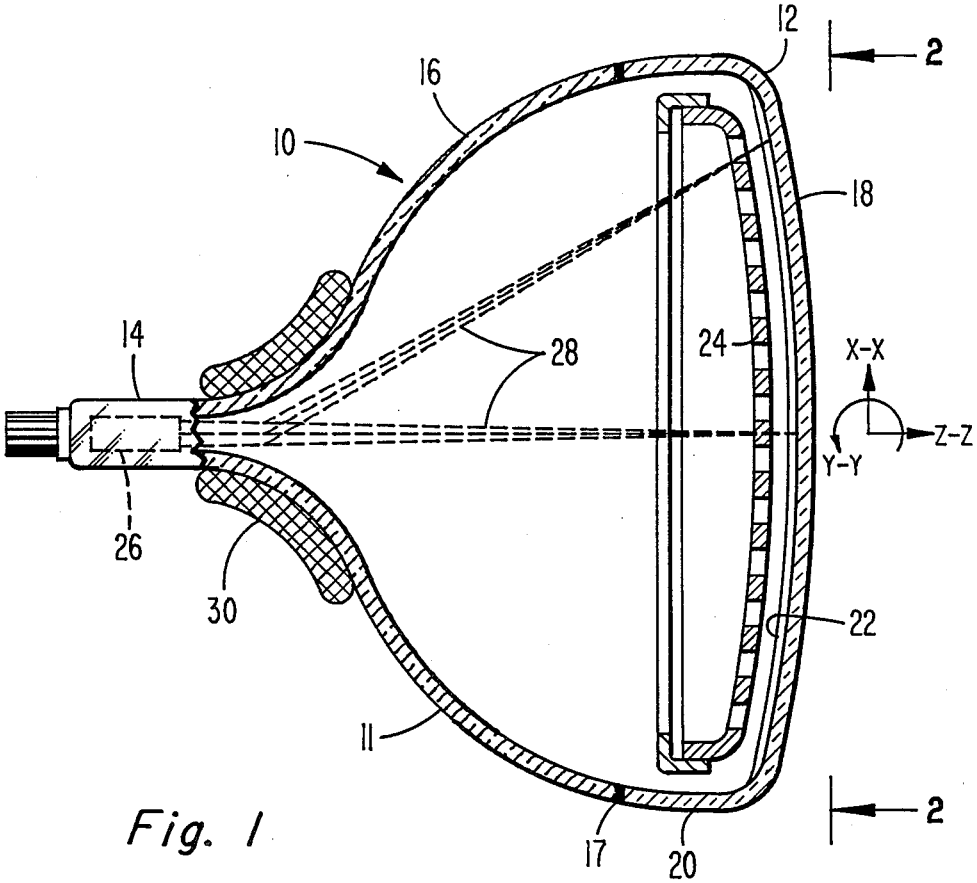
FIG. 1 is a plan view, partly in axial section, of a shadow mask color picture tube incorporating one embodiment of the present invention.

FIG. 1 shows a rectangular cathode-ray tube (CRT), in the form of a color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A rectangular three-color cathodoluminescent phosphor screen 22 is carried by the inner surface of the faceplate 18. The screen is preferably a line screen, with the phosphor lines extending substantially parallel to the minor axis Y—Y of the tube (normal to the plane of FIG. 1). Alternatively, the screen may be a dot screen. A multi-apertured color selection electrode or shadow mask 24 is removably mounted within the faceplate panel 12 in predetermined spaced relation to the screen 22. An inline electron gun 26, shown schematically by dotted lines in FIG. 1, is centrally mounted within the neck 14 to generate and direct three electron beams 28 along coplanar convergent paths through the mask 24 to the screen 22. Alternatively, the electron gun may have a triangular or delta configuration.

The tube 10 of FIG. 1 is designed to be used with an external magnetic deflection yoke, such as the yoke 30 schematically shown surrounding the neck 14 and funnel 16 in the nieghborhood of their junction, for subjecting the three beams 28 to vertical and horizontal magnetic flux, to scan the beams horizontally in the direction of th major axis (X—X) and vertically in the direction of the minor axis (Y—Y), respectively, in a rectangular raster over the screen 22.

Figure 2:
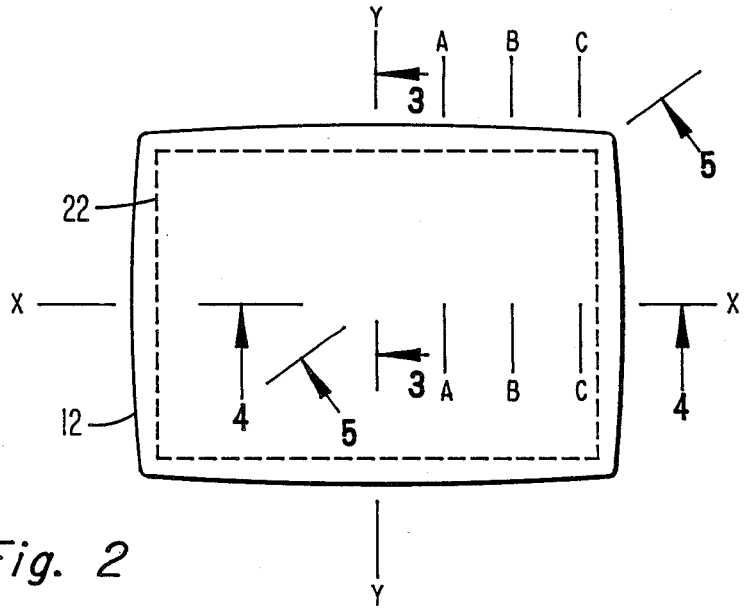
FIG. 2 is a front view of the faceplate panel of the tube of FIG. 1, taken at line 2—2 of FIG. 1.

FIG. 2 shows the front of the faceplate panel 12. The periphery of the panel 12 forms a rectangle with slightly curved sides. The border of the screen 22 is shown with dashed lines. This screen border is rectangular, with straight sides and square corners.

Figure 3:
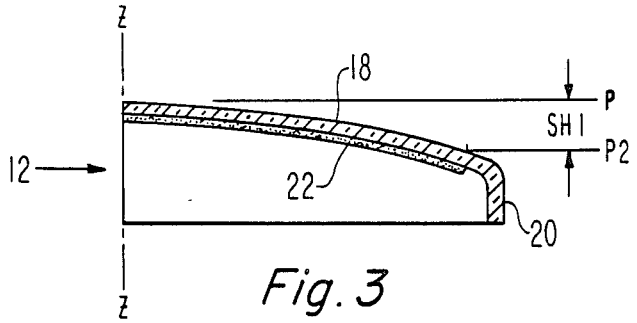
FIGS. 3, 4 and 5 are cross-sections of the faceplate panel of FIG. 2 taken at lines 3—3, 4—4 and 5—5, respectively, of FIG. 2.
Figure 4:
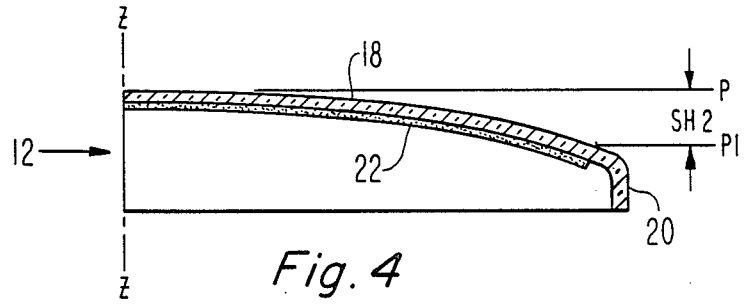
Figure 5:
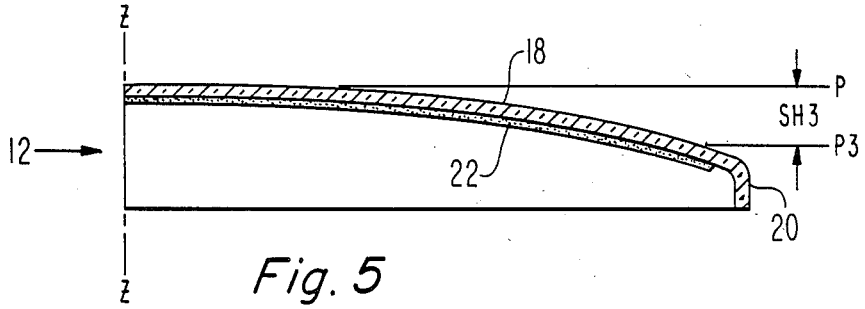

The specific panel cross-sections along the minor axis (Y—Y), the major axis (X—X) and the diagonal are shown in FIGS. 3, 4 and 5, respectively. The exterior surface of the faceplate panel 12 is curved along both the major and minor axes, with the curvature along the minor axis being greater than the curvature along the major axis at least in the center portion of the faceplate panel 12. For example, at the center of the faceplate, the ratio of the radius of curvature of the exterior surface contour along the major axis to the radius of curvature along the minor axis is greater than 1.1 (or greater than 10% difference). The "sagittal height" of a point on the panel contour is measured, from a plane (P) which is perpendicular to the longitudinal axis Z—Z of the tube and tangent to the center of the panel 12, to another plane (e.g., P1, P2 or P3) which is parallel to the plane P. The sagittal heights, SH1, SH2 and SH3, for points on the exterior surface of the faceplate 18 near the ends of the minor axis, major axis and diagonal, at the edges of the screen 22, are indicated in FIGS. 3, 4 and 5, respectively. The three sagittal heights shown follow the relationship: $SH1<SH2<SH3$.

Figure 6:
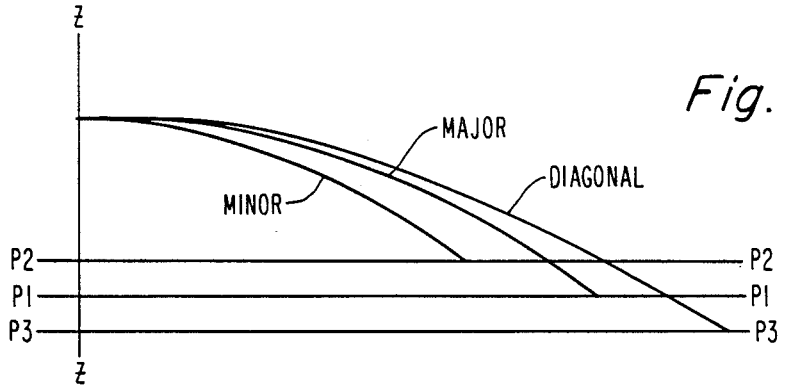
FIG. 6 is a composite diagram of the major axis, minor axis and diagonal contours of the faceplate panel of the tube of FIG. 1.

FIG. 6 shows the major axis, minor axis and diagonal exterior panel surface contours superposed on each other. Each contour ends at the edge of the screen. The major axis contour ends at a first plane P1 which is perpendicular to the longitudinal axis Z—Z of the tube. The minor axis contour ends at a second plane P2 which is spaced from and parallel to the first plane P1. The diagonal contour ends at a third plane P3 which is spaced from and parallel to the first plane P1. The three planes are spaced from the center portion of the faceplate in the order second plane P2, first plane P1 and third plane P3. Points on the exterior surface near the ends of the major axis, at the edges of the screen, lie in the first plane P1. Points on the exterior surface near the ends of the minor axis, at the edges of the screen, lie in the second plane P2. Points on the exterior surface near the ends of the diagonals, at the edges of the screen, lie in the third plane P3. The ratio of the spacing measured along the central longitudinal axis of the tube between the second plane P2 and the plane P tangent to the center of the faceplate to the spacing between the third plane P3 and the plane P is greater than the minor axis of the screen, squared, divided by the diagonal dimension of the screen, squared and less than one. In a tube having a screen with a 4:3 aspect ratio, the lower limit of the above spacing ratio is about 9/25. In another tube having a screen with a 5:3 aspect ratio, the lower limit of the above spacing ratio is about 9/34. Other minor factors also enter into the exact calculations of faceplate contours so that the ratios give above can only be considered to be approximate. Similarly, the ratio of the spacing between the first plane P1 and the plane P to the spacing between the third plane P3 and the plane P is greater than the major axis dimension of the screen, squared, divided by the diagonal dimension of the screen, squared, and less than one. In a tube having a 4:3 aspect ratio, the lower limit of this spacing ratio is about 16/25. In a tube with a 5:3 aspect ratio, the lower limit of the major axis spacing ratio is 25/34. In each case, the upper limit of one is excluded from the included range, since a ratio of one would indicate a planar edge faceplate. Alternatively, the spacing between the second plane P2 and the third plane P3 is substantially equal to the minor axis dimension of the screen, squared, divided by the diagonal dimension of the screen, squared, times the spacing between the third plane P3 and the plane P.

Figure 7:
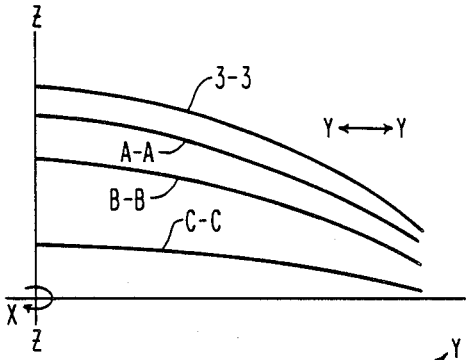
FIG. 7 is a composite diagram of the contours of the faceplate panel taken at lines 3—3, A—A, B—B and C—C of FIG. 2.

FIG. 7 shows the exterior surface contours parallel to the minor axis Y—Y taken at lines 3—3 (the minor axis), A—A, B—B and C—C of FIG. 2. Each contour is circular, with the radius of curvature of each cross-section increasing with increasing distance from the minor axis.

Figure 8:
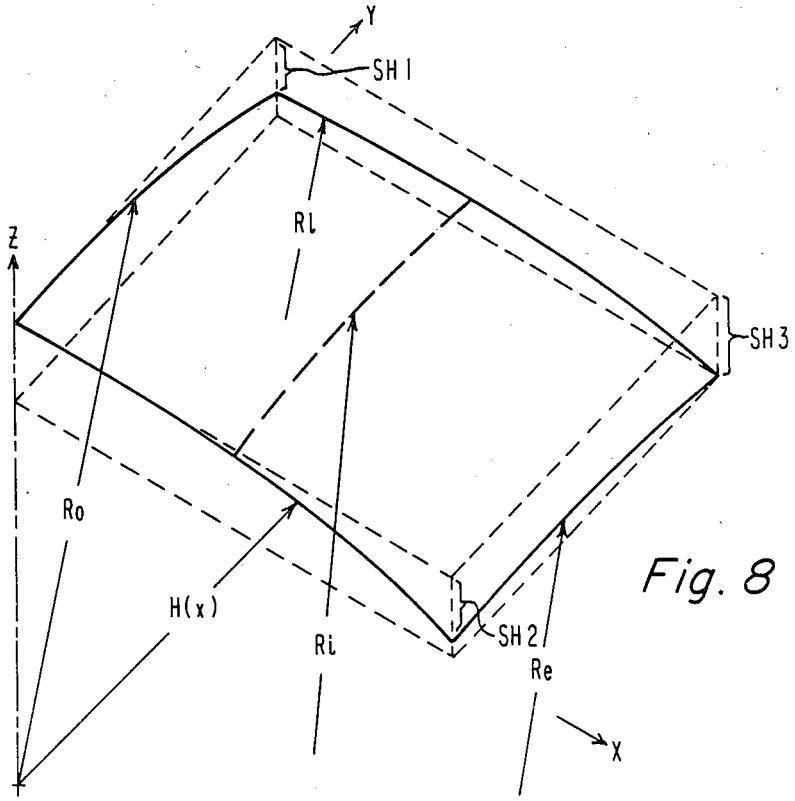
FIG. 8 is a diagram of a quadrant of the novel faceplate panel showing radii and functions of curvature.

The exterior surface for one embodiment of the faceplate is described by a fourth-ordered, even-functional, bivarient polynomial which provides a quadrant-symmetric, smoothed-surface description to a basic surface developed as shown in FIG. 8. The surface curvature along the minor axis is circular, with a radius of curvature Ro. The surface curvature at the sides of the faceplate, parallel to the minor axis, and at the edge of the screen also is circular, but with a radius of curvature Re. The surface curvature of sections parallel to the minor axis that are in between the minor axis and the sides of the screen are circular, with a radius of curvature Ri. The radius of curvature Ri is a function of distance along the major axis from the minor axis and meets the relationship: $Ro<Ri<Re$. The surface curvature at the top and bottom of the faceplate, parallel to the major axis, and at the edge of the screen is circular, with a radius of curvature Rl. The surface curvature along the major axis is a somewhat more complex function H(x) of distance from the minor axis. Basically, this major axis curvature is circular near the center of the faceplate, with a radius of curvature R, but increases in curvature near the sides of the faceplate. Such increase near the sides of the faceplate can be considered a pertubation on the basic radius of curvature R.

The following table gives dimensions for one tube having a 69-cm (27-inch) diagonal viewing screen constructed as disclosed herein.

TABLE

| | |
|---|---|
| SH1 | 18 mm |
| SH2 | 22 mm |
| SH3 | 26 mm |
| Ro | 1150 mm |
| Re | 5126 mm |
| Ri | >1150 mm and <5126 mm |
| Rl | 4574 mm |
| H(x) | Pertubated R of 1673 mm. |

The interior screen surface of the faceplate is defined by adding suitable wedging to the glass for strengthening purposes, as is known in the art, and reformulating the contour in bivarient polynomial form.

FIGS. 9 to 12 illustrate the major axis, minor axis and diagonal surface contours of a faceplate constructed in accordance with the present invention, as shown in dashed lines, compared to four prior faceplate contours, as shown in solid lines. All the tubes have a 69-cm (27-inch) viewing screen diagonal dimension.

Figure 9:
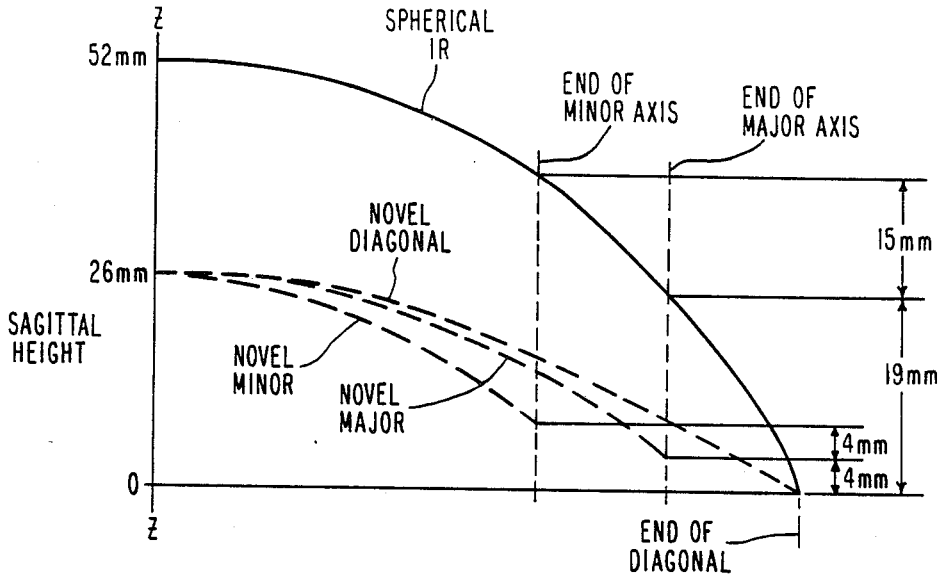
FIG. 9 is a diagram of major axis, minor axis and diagonal contours of the novel faceplate panel compared to a standard radius spherical panel.

A standard radius, 1R, spherical faceplate contour is shown in FIG. 9. An example of a standard radius, for a tube having diagonal dimension of about 635 mm, is about 1034 mm. Since the 1R faceplate is spherical, the major axis and minor axis contours lie on the diagonal contour. The sagittal height, measured between parallel planes passing the ends of the diagonal and the center surface of the faceplate, for the 1R faceplate is 52 mm. The sagittal height difference between the ends of the major and minor axes is about 15 mm, and the sagittal height difference between the ends of the major axis and the ends of the diagonals is about 19 mm.

Although the sagittal height at the end of the diagonal of the novel faceplate contour (26 mm) is one-half that of the standard 1R faceplate (52 mm), it should be noted that the curvature of the novel faceplate contour along the minor axis is very similar to the curvature of the 1R faceplate. Such curvature along the minor axis of the novel faceplate provides the strength needed, without greatly increasing glass thickness, to withstand atmospheric pressure when a tube is evacuated. In the following two spherical faceplates having longer radii of curvature, needed strength is obtained by using relatively thicker glass, resulting in heavier tubes.

Figure 10:
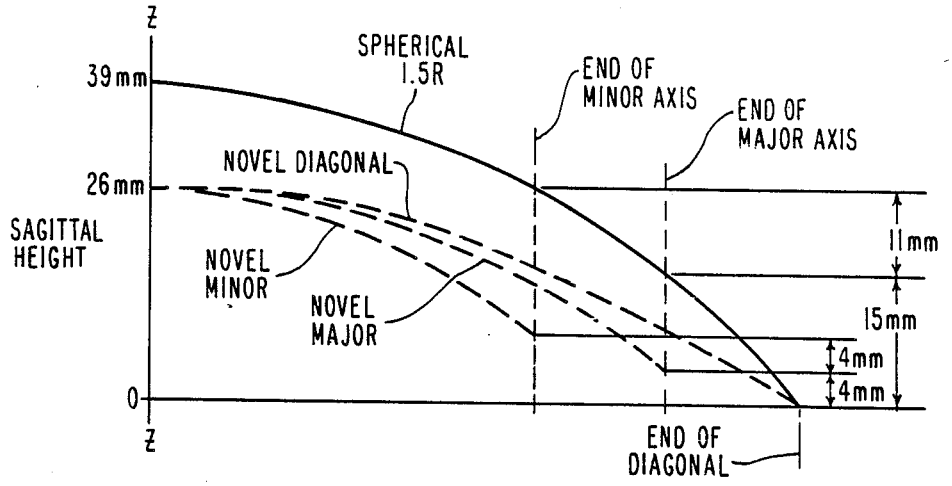
FIG. 10 is a diagram of major axis, minor axis and diagonal contours of the novel faceplate panel compared to a 1.5-times-standard radius spherical panel.

FIG. 10 shows a spherical faceplate contour having reduced curvature, with a radius of curvature 1.5 times that of the standard 1R facelate of FIG. 9, e.g. about 1500 mm. The sagittal height for the 1.5R faceplate is about 39 mm. The sagittal height difference between the ends of the major and minor axes is about 11 mm, and the sagittal height difference between the ends of the major axis and the ends of the diagonals is about 15 mm.

Figure 11:
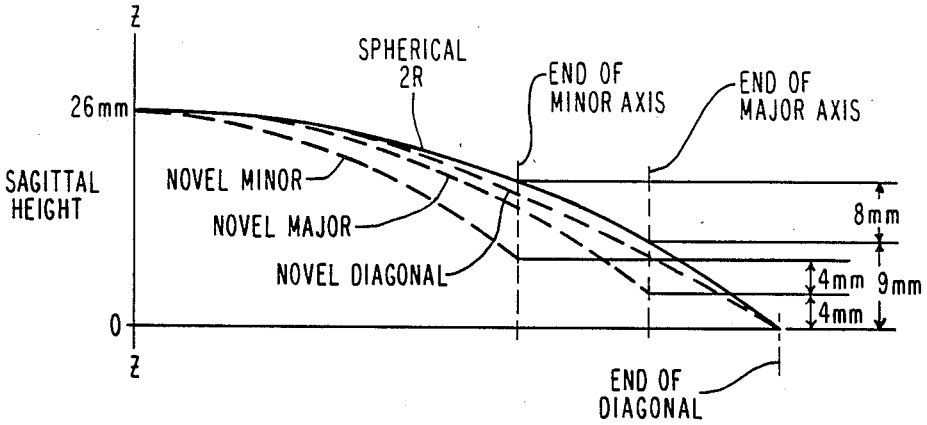
FIG. 11 is a diagram of major axis, minor axis and diagonal contours of the novel faceplate panel compared toa 2-times-standard radius spherical panel.

FIG. 11 shows a spherical faceplate contour having even less curvature, with a radius of curvature 2 times that of the standard 1R faceplate of FIG. 9, e.g. about 2000 mm. The sagittal height for the 2R faceplate is 26 mm, the same as that of the novel faceplate contour. The sagittal height difference between the ends of the major and minor axes is 8 mm, and the sagittal height difference between the ends of the major axis and the ends of the diagonals is about 9 mm.

Although spherical faceplates having even longer radii of curvature than the 2R faceplate are theoretically possible, the additional weight requied in the faceplate glass and the additional complexity in shadow mask design provide serious drawbacks to their commercialization. However, the present invention provides a novel faceplate and tube that circumvent these drawbacks while providing the viewing advantages of flatter faceplate tubes. The periphery of the novel faceplate 18 at the edges of the screen varies only ±4 mm from a plane passing through the ends of the major axis contour for a 69 cm diagonal tube. Because this variation is minor, the edges of the screen appear essentially flat to an observer. Such flatness at the edges of the screen creates an illusion that the screen is flat, even though there is curvature in the faceplate. As indicated by the sagittal height differences noted for the 1R, 1.5R and 2R spherical faceplate embodiments, such illusion of flatness is not possible for these spherical embodiments.

Figure 12:
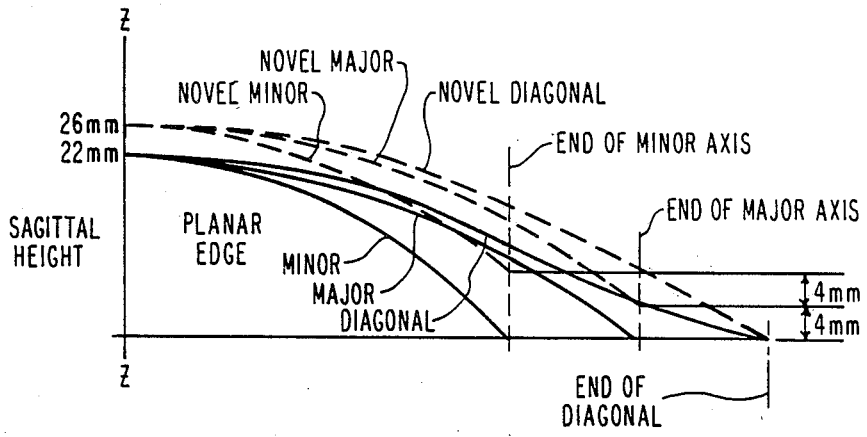
FIG. 12 is a diagram of major axis, minor axis and diagonal contours of the novel faceplate panel compared to a nonspherical planar edge panel.

FIG. 12 shows the major axis, minor axis and diagonal faceplate contours for a planar edge faceplate, such as discussed above in the Background of the Invention. Such contours do provide a truly planar screen periphery, however, in general, if the diagonal contour of this planar edge faceplate is formed with a substantial inflection some surface distortion may be observed. The present invention permits the formation of a smooth faceplate surface with no objectionable surface distortion.

Although the preferred embodimnent for a 69 cm diagonal tube is described with a sagital height difference between the first plane P1 and second plane P2 of 4 mm, and a difference between the first plane P1 and the third plane P3 also of 4 mm, the scope of the present invention also includes other sagital height differences, as indicated by the previously cited limits on spacing ratios. Furthermore, the present invention is not limited to any particular type of cathode-ray tube screen or electron gun.

What is claimed is:

1. In a cathode-ray tube including a rectangular faceplate with two long sides and two short sides wherein the long sides of the faceplate substantially parallel a centrally located major axis of the tube and the short sides of the faceplate substantially parallel a centrally located minor axis of the tube, said faceplate having an exterior surface having curvature along both its minor and major axes and said faceplate having a cathodoluminescent screen on an interior surface thereof, said tube including an electron gun therein for generating and directing at least one electron beam toward said screen, and wherein, at least in a center portion of the faceplate, a curvature along the minor axis is at least 10 percent greater than the curvature along the major axis; the improvement comprising points along the major axis on said exterior surface, located at the edges of said screen, lying in a first plane which is perpendicular to a central longitudinal axis of said tube;

points along the minor axis on said exterior surface, located at the edges of said screen, lying in a second plane which is spaced from and parallel to said first plane;

points along the diagonals of said faceplate on said exterior surface, located at the corners of said screen, lying in a third plane which is spaced from and parallel to said first plane;

said first, second and third planes being spaced from a fourth plane, which is parallel to said first, second and third planes and is tangent to the center portion of said faceplate, in the order of said second plane, said first plane and said third plane;

the ratio of the spacing between said second and fourth planes, measured along the central longitudinal axis of said tube, to the spacing between said third and fourth planes being greater than the minor axis dimension of the screen, squared, divided by the diagonal dimension of the screen, squared, and less than one;

the ratio of the spacing between said first and fourth planes, measuredalong the central longitudinal axis of said tube, to the spacing between said third and fourth planes being greater than the major axis dimension of the screen, squared, divided by the diagonal dimension of the screen, squared, and less than one; and the exterior surface curvature along said minor axis essentially being circular from the center of said faceplate to said second plane, and the exterior surface curvature along said major axis essentially being circular near the center of said faceplate and increasing in curvature near the sides of said faceplate to said first plane.

2. The tube as defined in claim 1, wherein the spacing between said first and second planes approximately equals the spacing between said first and third planes.

3. The tube as defined in claim 2, including said tube having a viewing screen with an approximate 69 cm diagonal and wherein the spacing between said first and second planes is about 4 mm and the spacing between said first and third planes is about 4 mm.

* * * * *